United States Patent [19]

Greiler

[11] Patent Number: 4,741,712

[45] Date of Patent: May 3, 1988

[54] LOW-PROFILE SOCKET FOR SINGLE-ENDED, HIGH-PRESSURE DISCHARGE LAMP

[75] Inventor: Wolfgang Greiler, Unterhaching, Fed. Rep. of Germany

[73] Assignee: Patent Treuhand Gesellschaft fur Elektrische Gluhlampen mbH, Munich, Fed. Rep. of Germany

[21] Appl. No.: 924,109

[22] Filed: Oct. 31, 1986

Related U.S. Application Data

[63] Continuation of Ser. No. 715,186, Mar. 22, 1985, abandoned.

[30] Foreign Application Priority Data

Apr. 3, 1984 [DE] Fed. Rep. of Germany ..... 3412461

[51] Int. Cl.[4] ..... H01R 33/02

[52] U.S. Cl. ..... 439/683; 439/689; 313/15

[58] Field of Search ..... 339/191 R, 191 L, 210 R, 339/210 T, 206 L, 62, 176 L, 177 L, 195 L, 154 L, 155 L, 125 L, 93 L, 94 L, 110 L, 198 J, 145 R, 144 T; 313/318, 623, 51

[56] References Cited

U.S. PATENT DOCUMENTS

| | | | |
|---|---|---|---|
| 2,941,181 | 6/1960 | Fraser et al. | 339/191 L |
| 3,614,710 | 10/1971 | Glickmann | 339/191 L |
| 3,960,278 | 6/1976 | Vause . | |
| 3,999,095 | 12/1976 | Pearce, Jr. et al. | 313/318 |
| 4,426,602 | 1/1984 | Mollet et al. | 313/318 |
| 4,533,851 | 8/1985 | Block et al. . | |

FOREIGN PATENT DOCUMENTS

| | | | |
|---|---|---|---|
| 3236462 | 4/1984 | Fed. Rep. of Germany . | |
| 0824165 | 1/1939 | France | 339/191 L |
| 1565825 | 3/1969 | France | 339/191 L |
| 2100503 | 12/1982 | United Kingdom . | |

OTHER PUBLICATIONS

Osram, Technical Catalogs, Jeanne Drive, Newburgh, N.Y. (Nov. 1985) (Oct. 1985) (Nov. 1984).

*Primary Examiner*—Gil Weidenfeld
*Assistant Examiner*—Thomas M. Kline
*Attorney, Agent, or Firm*—Frishauf, Holtz, Goodman & Woodward

[57] ABSTRACT

To provide a low-profile socket for a single-ended high-pressure discharge lamp, a ceramic body is formed with a recess and includes two connection terminal elements (8, 9) secured thereto. A separating wall (7) subdivides the recess in the socket body into two chambers (4, 5; 6), one each of the contact terminal elements being located in a respective chamber (8:4–5; 9:6). The socket body (2) is formed with an access opening (5, 18) to the lamp terminal connection end portions (10, 11) of the connection terminal elements and closed off towards the lamp base (FIG. 3:21) by cover plates (16, 17) presenting a flat engagement surface for matching surfaces on the lamp base. The separating wall (7) which subdivides the socket into the two chambers insures high resistance against high-voltage flash-over, which may be in the order of 25 kV during hot-starting ignition.

16 Claims, 2 Drawing Sheets

LOW-PROFILE SOCKET FOR SINGLE-ENDED, HIGH-PRESSURE DISCHARGE LAMP

This application is a continuation, of application Ser. No. 715,186, filed Mar. 22, 1985 now abandoned.

Reference to related application, assigned to the assignee of the present application, the disclosure of which is hereby incorporated by reference:

U.S. Ser. No. 715,185, filed Mar. 22, 1985, now abandoned GREILER.

Reference to related publication:

German Patent Publication DE-OS No. 32 36 462 to which U.S. Pat. No. 4,533,851 corresponds.

The present invention relates to a socket for a base of a single-ended high-pressure discharge lamp, and more particularly to a socket which is of low-profile construction, and readily capable of carrying off heat transmitted thereto from the base of the high-pressure discharge lamp, while easily permitting high voltage insulation and reception of terminals to engage terminal or connection pins or elements on the base of the lamp, and while holding the lamp securely in position in the socket, and preferably such that it can be accurately placed in a reflector.

BACKGROUND

Various types of sockets made of heat-resistant, electrically insulating material, such as cermaics and the like, are known; one socket is described, for example, in German Patent Publication DE-OS No. 32 36 462 to which U.S. Pat. No. 4,533,851 corresponds. Such sockets can accept voltages of more than 20 KV with good operating reliability and safety regarding electrical data; such voltages are necessary in order to re-ignite a high-pressure discharge lamp, for example after having been operated before, that is, to ignite the discharge lamp under hot conditions. It is necessary that the terminal ends for the supply voltage and for the high-voltage ignition pulses are spaced sufficiently apart and insulated from each other to prevent sparks or flash-over. Yet, it is also necessary that the high-voltage terminals are accessible so that the lamp and a lamp base can be readily inserted into the socket. Structures like the one described in the referenced U.S. Pat. No. 4,533,851, or corresponding German Publication No. 32 36 462, while entirely suitable from an electrical point of view, have been found to have high heat capacity due to their high mass. The lamp, which operates at high temperatures, transfers heat to the base and to the socket and this heat is not readily radiated; this is disadvantageous for operation of the lamp and, particularly, for operation of the lamp in a reflector of fixture. The base is quite large and if the lamp is to be inserted into a reflector, the resulting opening necessary in the reflector to permit introduction of the base of the lamp and also of the massive socket detracts from the light output since some of the light will not be reflected from the reflector but, rather, will be directed towards the lamp base and the lamp socket, contributing only to the undesirable heating thereof. The engagement surface of the lamp is located at the bottom of a collar accepting the socket bushings. The resulting construction is axially comparatively long; so that positioning of the lamp within the reflector at an accurately predetermined location in relation to its focal point is difficult.

THE INVENTION

It is an object to so construct the socket that is can be made smaller than heretofore thought possible, results in excellent positioning of the lamp and its base within a reflector or another optical system, and does not heat and absorb heat derived from the lamp.

Briefly, the socket includes a socket body formed with a recess adapted to receive a lamp base locating stub. The socket body is made of heat-resistant, insulating material, such as a ceramic, and has two connection terminal elements secured thereto, the connection terminal elements being, for example, connected to external cables which, in turn, can be connected to a suitable power and high-voltage starting supply. In accordance with a feature of the invention, a separating wall subdivides the recess within the socket body into two chambers, each one of which retains a contact terminal element. The socket body is formed with an access opening to the chambers to receive the lamp base, the lamp terminal connection elements extending into the respective chambers to engage lamp base connection terminal pins, blades or the like.

The separating wall which subdivides the socket body into two chambers provides for excellent insulation and separation of the end portions of the connection terminals of the socket; closing off the chambers towards the top—except for an access opening for the lamp base and the lamp termainl pins or blades—substantially increases the safety of the socket and effectively prevents inadvertent touching of the terminals by a user. One fo the chambers is divided into two portions to separately receive the cable connection end and the lamp terminal contacting end of one of the contact terminal elements. The terminal elements, preferably, are elongated blade-like or spring-blade structures having the end portions thereof closer together than the outer ends, to which cables can be connected, and preferably located in a straight line which extends at right angles to the longitudinal axis of the lamp to be inserted into the socket. The resulting structure is surprisingly compact, and especially low in profile. The insertion direction of the lamp terminal pins or blades preferably extends parallel to the longitudinal axis of the lamp; one of the lamp connection terminals, preferably, is concentric with the longitudinal axis of the lamp. This permits simple insertion movement of the lamp and its base into the socket by longitudinal plug insertion. It is then easily possible to couple a removal prevention device with the base or, for example, with at least one of the contact elements in the base, to prevent undesired or unintended removal of the lamp from the socket.

In a preferred form of the invention, the connection terminal elements on the socket are formed as spring elements, especially as leaf springs, which are particularly suitable to permit the socket to be flat and of low profile. One of the connecting portions directly intersects the longitudinal axis of the lamp to be inserted into the socket, and engages a lamp connecting pin or the like which is fitted in a recess of a locating stub, which may, preferably, have rectangular cross section - see the referenced application by the inventor hereof. This insures excellent handling of the lamp during insertion, and fit of the lamp having a correpsonding base into the socket.

The socket additionally preferably is formed with a centering recess, preferably of circular cross section, which can receive a corresponding projecting collar on the base of the lamp. Forming such a collar which fits into a socket in the base-socket combination increases the resistance to voltage flash-over, and additionally insures excellent holding of the lamp and its base within the socket. Sharp edges formed in the socket further contribute to high voltage resistance of the socket since dirt and the like hardly collects at a sharp edge, so that sharp edges provide excellent insulation effects. Covers, such as cover plates, close off the chambers in the socket at the side facing the lamp, and the lamp base, preferably located flat and at right angles to the axis of the lamp and forming engagement surfaces for corresponding matching engagement surfaces on the base of the lamp, thereby additionally insuring accurate positioning of the lamp in the socket.

DRAWINGS

DETAILED DESCRIPTION

Figure 1:
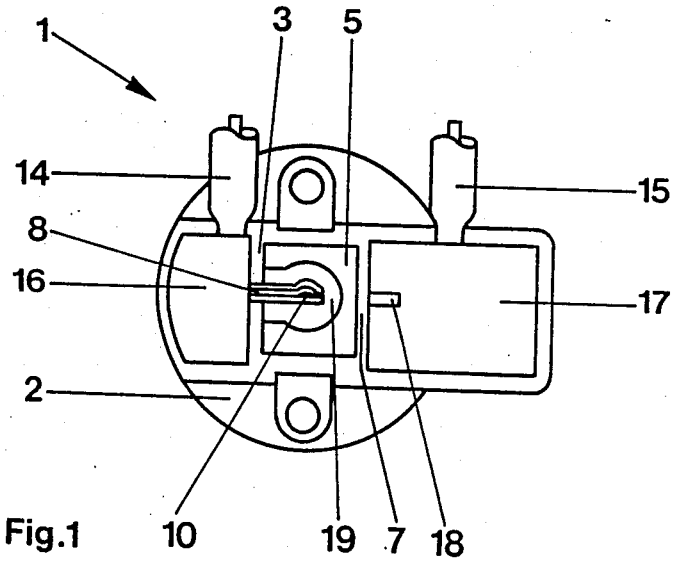
FIG. 1 is a top view of the socket, without a lamp being inserted therein.

The socket 1 (FIGS. 1, 2) has a socket body 2 made of a ceramic. The socket body 2 is subdivided by a wall 7 into two chambers 4–5 and 6. The chamber 4 includes two portions, a centering portion 5, separated from a remaining portion 4 by a rib or step 3. The chamber portion 4 and the centering portion 5 are isolated from the chamber and hence from each other by the wall 7. Chamber portion 4 and chamber 6 retains respective connection terminal element 8, 9 which has, each, a cable connection end portion 10, 11 as well as a connecting end portion 12, 13. The connection terminal elements 8, 9 are secured in the respective chambers 4 and 6 in any well known manner. The connection end portions 10, 11 are adapted to engage connection pins or blades on the base of a lamp; the cable connecting end portions 12, 13 can be connected to external cables 14, 15 (FIG. 1), preferably insulated for high voltage and adapted to be connected to a suitable source of supply voltage which may, additionally, include a source of firing voltage in the order of 25 kV to be applied to the connection terminal element 8. The portion 4 and chamber 6 are closed off by closing walls 16, 17 located at the top, in the form of plates, for example made of ceramic or mica. The chamber portion 4 at the left of the centering portion 5—with respect to FIGS. 1 and 2—is completely covered by the cover plate 16. The cover plate 17 completely covers the chamber 6 and the connection terminal end portion 11 of the connection terminal 9, except for an access opening 18 formed therein to permit access by a blade or pin terminal on the base of the lamp to the terminal element 9. The two covers 16, 17 of ceramic or mica, for example, are located in a single plane, which forms an engagement surface for a lamp base, and thereby insure precise positioning of a lamp in a reflector or an optical system.

The connection terminal end 10 of the connection element 8 has its receiving portion located on the longitudinal axis of the lamp and is positioned centrally within the centering portion 5. It extends freely, cantilevered, therein, without contact with wall 7 or the walls defining the chamber, except where is passes into chamber portion 4. The cable connection end portion 12 of terminal 8 is retained in chamber portion 4—see FIG. 2. The connection element 8 supplied operating current and also the high-voltage ignition to the lamp. The centering portion 5 is shaped to fit a centering stub formed on the base of the lamp—for example of rectangular cross section—and likewise will then have rectangular cross section. The rectangular centering portion, in longitudinal or axial direction, is extended in a depression 19 which, preferably, is at least approximately of circular cross section. The depression 19 is provided to receive a similar collar on the centering stub of the lamp.

Figure 3:
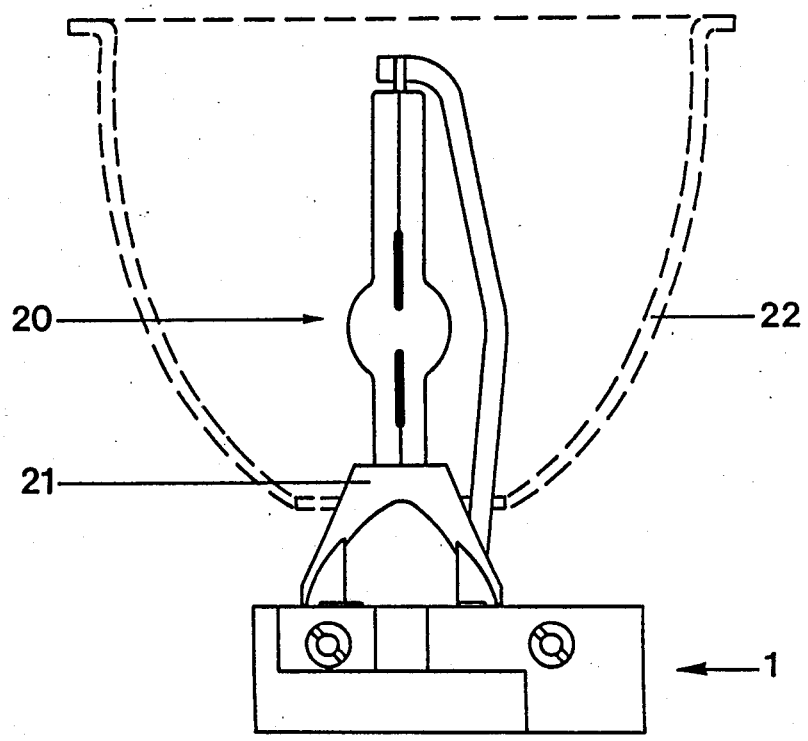
FIG. 3 is a schematic side view of the socket, with a lamp and a lamp base inserted therein, and illustrating the positioning of the lamp and its base within a reflector.

FIG. 3 illustrates a lamp 20 inserted into the socket 1. The lamp base 21 engages the covers 16 and 17 on the plane formed thereby, thus insuring excellent placement and adjustment of the lamp 20 within a reflector 22 of a fixture or with respect to any other optical system.

The socket is preferably used for, and in combination with, metal halogen high-pressure discharge lamps; it is equally useful for high-pressure discharge lamps of other types, for example high-pressure discharge lamps without halogen additives, or with noble-gas lamps. The lamp 20—FIG. 3—is operated with a no-load voltage of above 250 V. Such lamps are particularly suitable for motion picture and television studio use without flicker. To ignite such a lamp, particularly for rapid reignition of a lamp which is already hot, an ignition voltage of up to 25 kV is required, applied between the connection terminal elements 8 and 9.

In accordance with a feature of the invention, the connection terminals 8, 9 of the socket are reliably insulated and separated even with respect to such a high ignition voltage, so that flash-over or arc-over is reliably prevented. The wall 7 reliably separates the contact terminals 8, 9 and the lamp base structure itself, fitting within the opening portion 5, and also of insulating material, preferably of ceramic, further contributes to the high voltage resistance of the base and lamp.

Figure 2:
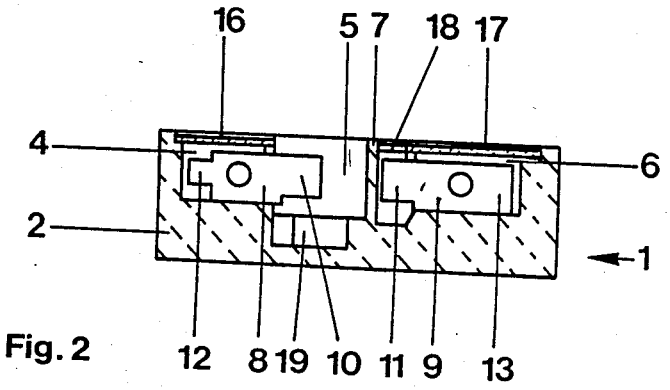
FIG. 2 is a vertical sectional view of the socket of FIG. 1.

The vertical dimension of the socket—see FIG. 2—is small and thus permits association with a lamp in a sturdy and rugged construction, while permitting ready exchange of the lamp. Excellent focussing of the light available from the lamp within a fixture is readily possible since the distance from the lowest wall of the socket to the discharge zone of the lamp is substantially less than in prior art structures, thus preventing inaccuracies due to misalignment and tolerances within the ceramic socket.

I claim:

1. High voltage resistant socket, particularly for use with a single-ended high-pressure discharge lamp (20) having a longitudinal axis, and a single base (21), and being subject to voltage surges in the range of kilovolts, comprising a disk-like body (2) defining an outer region adjacent an outer peripheral surface, said body being of temperature-resistant insulating material, and defining a top surface, said disk-like body being formed with a recess (4, 5, 6) beneath the top surface;

top means (16, 17) of insulating material partly closing off said recess;

a first and a second elongated connection terminal element (8, 9), each secured to the body, each connection terminal element having a supply cable connecting end portion (12, 13) located at the outer region of said body and a lamp terminal connection end portion (10, 11) located inwardly of said outer region, a separating wall (7) extending up to about the top surface and subdividing the recess of the body (2) into a first chamber (4, 5) and a second chamber (6), the first chamber defining a frist chamber portion (4) and a second chamber portion (5), the first chamber portion (4) being located adjacent the outer region of said body and receiving said supply cable connecting end portion (12) of said first terminal element and the second chamber portion (5) being located at an inner region of the body adjacent said first chamber portion (4) and being closed off against said second chamber (6) by said separating wall (7), the first connection terminal element (8) being located in the first chamber (4, 5) and the second connection terminal element (9) being located in the second chamber (6), the first connection terminal element (8) extending cantilevered from said first chamber portion (4) of the first chamber toward the inner region of the socket body and into the second chamber portion (5) of the first chamber and being spaced from said separating wall (7), wherein the top means (16, 17) of the socket body (2) is formed with an access opening leading to the second chamber (6) and to the lamp terminal connection and portion (11) of the connection terminal element (9) therein, said second chamber portion (5) of the first chamber (4, 5) is open for reception of a portion of said single base (21) of the lamp (20); and wherein said second chamber portion (5) has a cross-sectional shape and area matching said portion of the base (21) of the lamp to be used with the socket.

2. Socket according to claim 1, wherein the distance between the lamp terminal connection end portions (10, 11) of the connection terminal elements (8, 9) is less than the distance between the supply cable connecting end portions (12, 13) of the connection terminal elements (8);

and wherein the connection terminal elements (8, 9) are located entirely within the socket body (2).

3. Socket according to claim 2, wherein the connection terminal elements (8, 9) are located in a straight line, extending at a right angle with respect to the longitudinal axis of the lamp (20) adapted for insertion into the socket.

4. Socket according to claim 2, wherein the lamp terminal connection end portions (10, 11) define projecting portions positioned within the socket body (2) for wiping, sliding engagement with lamp terminal connecting pins or blades, said lamp terminal connection end portions (10, 11) extending in a plane congruent with a plane in which the lamp (20) is moved during an insertion or withdrawal operation.

5. Socket according to claim 3, wherein the lamp terminal connection end portion (10) of one of the connection terminal elements (8) is located at a position which intersects the longitudinal axis of the lamp (20) when the lamp is received in the socket.

6. Socket according to claim 1, wherein the connection terminal elements (8, 9) comprise leaf springs.

7. Socket according to claim 3, wherein the connection terminal elements (8, 9) are formed as leaf springs.

8. Socket according to claim 1, wherein said second chamber portion (5) forms a centering chamber for said portion of the base (21) of the lamp to be inserted in the socket;

and a rib (3) is provided, said rib being located within the socket body (2) and separating the second chamber portion (5) from the first chamber portion (4).

9. Socket according to claim 1, wherein the top means comprises cover elements (16, 17) forming said top surface, partly closing off said first and second chambers and extending at right angle to the longitudinal axis of the lamp (20) ot be used with the socket.

10. Socket according to claim 1, wherein the contact terminal elements (8, 9) in the socket extend laterally with respect to the longitudinal axis of the lamp (20).

11. Socket according to claim 10, wherein the contact terminal elements (8, 9) are located in a common plane, said common plane including the longitudinal axis of the lamp.

12. Socket according to claim 9, wherein said cover elements (16, 17) include cover plates comprised of mica or ceramic material.

13. High voltage resistant socket for use with a single-ended, single-based high pressure discharge lamp (20) having a base (21) of predetermined shape and a longitudinal axis comprising a socket body (2) of temperature-resistant insulating material having a top wall means (16, 17) and a lamp base receiving recess beneath said top wall means;

a first and a second connection terminal element (8, 9), each secured to the socket body, each connection terminal element having a supply cable connecting end portion (12, 13) and a lamp terminal connection end portion (10, 11);

a separating wall (7) subdividing the recess of the body (2) into a first chamber (4, 5) and a second chamber (6), the first chamber defining a first chamber portion (4) and a second chamber portion (5), the first portion (4) retaining the supply cable connecting end portion (12) of the first connection terminal element (8) and the second chamber portion (5) forming a centering chamber portion for a portion of the base (21) of the lamp to be inserted in the socket;

said first connection terminal element (8) extending into said second chamber portion (5) with the lamp terminal connection end portion (10) thereof being located in said second chamber portion;

the lamp terminal connection end portion (11) of the second connection terminal element (9) being located in the second chamber (6);

wherein the top wall means of the socket body (2) is formed with an access opening leading to the second chamber (6) and to the lamp terminal connection end portion (11) of the second connection terminal element (9) therein, said centering chamber portion (5) of the first chamber (4, 5) is open for reception of a portion of said base (21) of the lamp (20); and wherein a rib (3) is provided, located within the socket body (2) and separating the second chamber portion (5) from the first chamber portion (4).

14. Socket according to claim 13, wherein the connection terminal elements (8, 9) are located entirely within the socket body;

and wherein the connection terminal elements (8, 9) comprise elongated elements located in a straight line, extending at right angles with respect to the longitudinal axis of the lamp (20) adapted for insertion into the socket.

15. Socket according to claim 13, wherein the connection terminal elements (8, 9) in the socket body extend laterally with respect to the longitudinal axis of the lamp (20).

16. Socket according to claim 13, wherein the second chamber portion (5) has essentially rectangular cross section;

and the second chamber portion (5) forms a depression within the socket body (2) of essentially circular cross section which is deeper than the first chamber portion.

* * * * *